US006375784B1

(12) United States Patent
Ohsawa et al.

(10) Patent No.: US 6,375,784 B1
(45) Date of Patent: Apr. 23, 2002

(54) METHOD OF MANUFACTURING REVERSIBLE HEAT-SENSITIVE RECORDING MEDIUM AND REVERSIBLE HEAT-SENSITIVE RECORDING MEDIUM MANUFACTURED THEREBY

(75) Inventors: Haruhiko Ohsawa; Makibi Nakanishi; Hiroyuki Morinaka; Junpei Nakagawa; Koh Fujii, all of Tokyo (JP)

(73) Assignee: Kyodo Printing Co., Ltd, Tokyo (JP)

( * ) Notice: Subject to any disclaimer, the term of this patent is extended or adjusted under 35 U.S.C. 154(b) by 0 days.

(21) Appl. No.: 09/534,333

(22) Filed: Mar. 24, 2000

(30) Foreign Application Priority Data

Mar. 26, 1999 (JP) ..... 11-083302

(51) Int. Cl.[7] ..... B41M 5/40

(52) U.S. Cl. ..... 156/235; 427/152; 503/200; 503/201; 503/226

(58) Field of Search ..... 503/200, 201, 503/226; 427/152; 156/235

(56) References Cited

FOREIGN PATENT DOCUMENTS

| | | |
|---|---|---|
| JP | 57109695 | 7/1982 |
| JP | 4-55876 | 9/1992 |
| JP | 6-210954 | 8/1994 |
| JP | 10309869 | 11/1998 |

OTHER PUBLICATIONS

Publication entitled "Surface Roughness—Definitions and Designation", published Jan. 6, 1994.

*Primary Examiner*—Bruce H. Hess
(74) *Attorney, Agent, or Firm*—Greenblum & Bernstein, P.L.C.

(57) ABSTRACT

A method of manufacturing a reversible heat-sensitive recording medium capable of manufacturing a reversible heat-sensitive recording medium invulnerable toward scratches, etc. even when printing/erasing is repeated under situation where dirt and dust tend to attach to the reversible heat-sensitive recording medium, thus providing increase durability of the reversible heat-sensitive recording medium against repeated printing/erasing. In the method of manufacturing the reversible heat-sensitive recording medium containing a reversible heat-sensitive recording layer and a substrate sheet, a reversible heat-sensitive recording sheet or a reversible heat-sensitive recording transfer sheet having the reversible heat-sensitive recording layer applied to the substrate sheet through welding, after which a protective layer is formed on the reversible heat-sensitive recording layer.

7 Claims, 4 Drawing Sheets

METHOD OF MANUFACTURING REVERSIBLE HEAT-SENSITIVE RECORDING MEDIUM AND REVERSIBLE HEAT-SENSITIVE RECORDING MEDIUM MANUFACTURED THEREBY

BACKGROUND OF THE INVENTION

The present invention relates to a method of manufacturing reversible heat-sensitive recording medium and a reversible heat-sensitive recording medium obtained by this method of manufacturing reversible heat-sensitive recording medium.

DESCRIPTION OF THE RELATED ART

With respect to a variety of cards including ID cards, pre-paid cards, etc., for instance, a reversible heat-sensitive recording medium with reversible heat-sensitive recording materials provided in layers has been adopted along with a magnetic recording, for a reversible heat-sensitive recording medium is capable of repeatedly erasing and/or writing information for the purpose of indicating an account balance, etc. Such reversible heat-sensitive recording medium does not require any developing process, and further, it has a high color-developing density. What is more, it is inexpensive and widely used.

In such a reversible heat-sensitive recording medium used for cards etc., erasing and/or writing process is implemented by heating a reversible heat-sensitive recording layer by a thermal head, etc. at a certain temperature in order to develop or erase colors such that desired characters, etc. can be displayed.

In order to protect the reversible heat-sensitive recording layer from any mechanical and physical stresses when coloring and discoloring by heating, it has been typical to adopt a protective layer on the surface of the reversible heat sensitive recording layer. By applying such protective layer, it is possible to improve the durability of the reversible heat-sensitive medium containing the reversible heat-sensitive recording layer, causing it to be able to last against repeated printing and erasing by heat.

It has been a problem that when printing or erasing, dirt, etc. on the surface of the reversible heat-sensitive recording medium and dust, etc. from the surrounding environment stick to the thermal head, etc., which conducts the thermal recording, cause scratches, sticking, etc. on the printing surface of the reversible heat-sensitive recording medium. Furthermore, another problem would be a bad visibility of printed characters due to glaring on the surface caused by the protective layer being highly smooth.

In view of the foregoing, the inventors of the present invention have proposed a reversible heat-sensitive recording medium as disclosed in Japanese Patent Laid-Open Publication No. 10-309869, which resolves all the above-mentioned problems. A reversible heat-sensitive recording medium capable of overcoming the above-mentioned problems is made possible due to such invention of a reversible heat-sensitive recording medium having a protective layer.

On the other hand, in recent years, there has been a growing need for forming a reversible heat-sensitive recording layer for credit cards, IC cards, etc. in order to show certain information, and therefore, the reversible heat-sensitive recording layer is constructed as applied to a transfer sheet or an adhesive sheet to be formed on the substrate sheet of a medium such as a card, etc. in an approximate flush state by being welded to the substrate sheet, etc. (adhered to the substrate sheet, etc. through heat fusion). Therefore, sometimes, the heating and pressurizing at the time of heat fusing cause the protective layer provided to the transfer sheet and the adhesive sheet together with the reversible heat-sensitive recording layer to become nearly like a mirror surface, eventually causing the above-mentioned problems of causing stains on the thermal head, scratchy printed characters, and low visibility due to sticking and glaring on the surface of the protective layer.

SUMMARY OF THE INVENTION

It is an object of the present invention to provide a reversible heat-sensitive recording medium and a method of manufacturing it, the reversible heat-sensitive recording medium provided as being invulnerable toward scratches, etc. even when printing/erasing is repeated under situation of dirt and dust attached to the reversible heat-sensitive recording medium, thus having improved durability against repeated printing/erasing. The inventors of the present invention have come to a completion of the invention as a result of their pursuit of developing a method of manufacturing reversible heat-sensitive recording medium, including a welding process, effectively using an unevenness of the surface of the protective layer.

In accordance with a first aspect of the present invention, there is provided a method of manufacturing reversible heat-sensitive recording medium having a reversible heat-sensitive recording layer and a substrate sheet, wherein a reversible heat-sensitive recording sheet or a reversible heat-sensitive recording transfer sheet having the reversible heat-sensitive recording layer is applied to the substrate sheet through welding, after which a protective layer is formed on the reversible heat-sensitive recording layer.

In accordance with a second aspect of the present invention, there is provided a method of manufacturing reversible heat-sensitive recording medium as mentioned in the first aspect, wherein the protective layer contains porous filler.

In accordance with a third aspect of the present invention, there is provided a method of manufacturing reversible heat-sensitive recording medium as mentioned in the second aspect, wherein an average particle diameter of said porous filler is within the range of 0.7–2.5 times of a thickness of said protective layer.

In accordance with a fourth aspect of the present invention, there is provided a method of manufacturing reversible heat-sensitive recording medium as mentioned in the first aspect, wherein the reversible heat-sensitive recording sheet or reversible heat-sensitive recording transfer sheet does not have a protective layer.

In accordance with a fifth aspect of the present invention, there is provided a method of manufacturing reversible heat-sensitive recording medium as mentioned in the fourth aspect, wherein the reversible heat-sensitive recording layer is composed of a leuco dye, a color developing/reducing agent, and a binder resin as its main constituents.

In accordance with a sixth aspect of the present invention, there is provided a method of manufacturing reversible heat-sensitive recording medium having a reversible heat-sensitive recording layer and a substrate sheet, wherein a reversible heat-sensitive recording sheet or a reversible heat-sensitive recording transfer sheet having the reversible heat-sensitive recording layer is applied to the substrate sheet through welding, after which a protective layer is coated on said reversible heat-sensitive recording layer, the protective layer having a surface roughness within a range of Ra values 0.10–0.60 $\mu$m, the Ra values prescribed by JIS B 0601.

In accordance with a seventh aspect of the present invention, there is provided a reversible heat-sensitive recording medium, wherein a protective layer is formed on a reversible heat-sensitive recording layer of a welded product of a reversible heat-sensitive recording sheet or a reversible heat-sensitive recording transfer sheet having the reversible heat-sensitive recording layer and a substrate sheet through welding, the protective layer having a surface roughness within a range of Ra values 0.10–0.60 $\mu$m, the Ra values prescribed by JIS B 0601.

In this kind of reversible heat-sensitive recording medium of the present invention, since the protective layer is formed on the reversible heat-sensitive recording layer of the welded product of the reversible heat-sensitive recording sheet or reversible heat-sensitive recording transfer sheet and the substrate sheet, microscopic unevenness on the surface of the protective layer will not be destroyed.

Consequently, it is possible to provide a reversible heat-sensitive recording medium invulnerable toward scratches, etc. even when printing/erasing is repeated under situation of dirt and dust attached to the surface of the reversible heat-sensitive recording medium. Furthermore, due to the protective layer formed in accordance with the present invention, it is possible to prevent the thermal head from having dirt, etc. attached thereto, and it is further possible to prevent the thermal head from microscopic scratches, etc.

BRIEF DESCRIPTION OF THE DRAWINGS

The above and further objects and the novel feature of the invention will more fully appear from the following detailed description when the same is read in connection with the accompanying drawings, in which.

DETAILED DESCRIPTION OF THE PREFERRED EMBODIMENTS

Figure 1A:
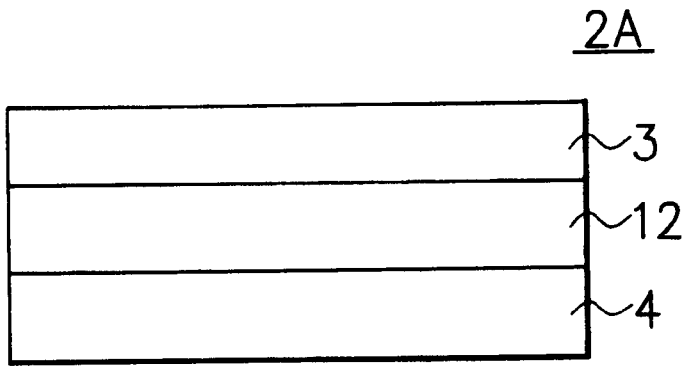
FIG. 1A is a sectional schematic view showing a basic laminating structure of a reversible heat-sensitive recording sheet.

Referring now to the drawings, descriptions of preferred embodiments of the present invention will be given in detail.

According to the manufacturing method of a reversible heat-sensitive recording medium of the present invention, the reversible heat-sensitive recording medium includes a reversible heat-sensitive recording layer and a substrate sheet, and it is characterized in that a reversible heat-sensitive recording sheet or a reversible heat-sensitive recording transfer sheet including a reversible heat-sensitive recording layer and a substrate sheet are attached to each other through welding, after which a protective layer is formed on the reversible heat-sensitive recording layer.

In the following, descriptions will be first given on the reversible heat-sensitive recording sheet, reversible heat-sensitive recording transfer sheet, substrate sheet and the protective layer, which are used in the present invention.

Reversible Heat-Sensitive Recording Sheet

As can be seen in FIG. 1A, a reversible heat-sensitive recording sheet 2A used in the present invention includes a reversible heat-sensitive recording layer 3, an adhesive layer 4 for mounting the reversible heat-sensitive recording sheet 2A on a substrate sheet 5, etc. and a base material. Further, the reversible heat-sensitive recording sheet can have a concealing layer, an intermediate layer, and a barrier layer, etc., which will be described later on.

Reversible Heat-Sensitive Recording Transfer Sheet

Figure 1B:
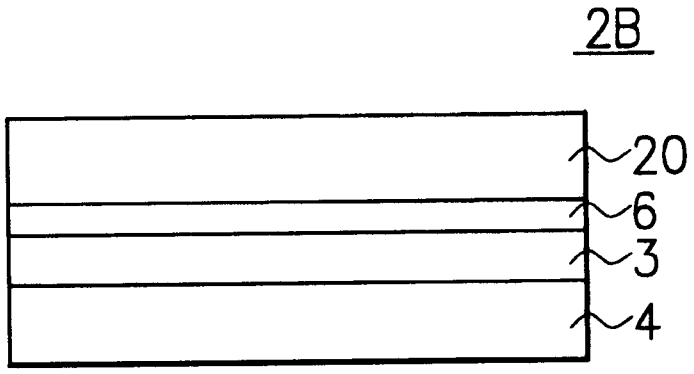
FIG. 1B is a sectional schematic view showing a basic laminating structure of a reversible heat-sensitive recording transfer sheet.

As can be seen in FIG. 1B, a reversible heat-sensitive recording transfer sheet 2B includes a sheet base material 20, a separating layer 6, a reversible heat-sensitive recording layer 3, and an adhesive layer 4 for mounting the reversible heat sensitive recording transfer sheet 2B on the substrate sheet, etc. through welding. Furthermore, the reversible heat-sensitive recording transfer sheet can have a concealing layer, screening layer, barrier layer and other recording layers, etc. Those layers should be provided for concealing irreversible color developing on the adhesive layer 4, which is caused when a leuco dye and the adhesive layer 4 react with each other, in case when the leuco dye generated from the reversible heat-sensitive recording layer 3 sticks to the adhesive layer 4 when forming a slit to the reversible heat-sensitive recording transfer sheet for separation and then welding this adhesive layer 4 with the leuco dye. To be more precise, in this specification, the definition of reversible heat-sensitive recording transfer sheet includes a reversible heat-sensitive recording transfer sheet after having a sheet base material being separated.

Next, descriptions will be given on the layers forming the reversible heat-sensitive recording sheet 2A as shown in FIG. 1A, and the reversible heat-sensitive recording transfer sheet 2B, respectively.

Adhesive Layer

The adhesive layer 4 is sufficient enough if it is capable of effecting sufficient bonding when the reversible heat-sensitive recording sheet 2A or the reversible heat-sensitive recording transfer sheet 2B is applied to the substrate sheet 5 through welding, etc. In general, polyester resin, alkyd resin, vinyl resin, or polyurethane resin can be used. Alternatively, a mixed resin of the above types of resins can also be used.

Reversible Heat-Sensitive Recording Layer

The reversible heat sensitive recording layer 3 is a layer which is capable of reversibly recording and erasing information by heating using for instance a thermal head, etc.

The reversible heat-sensitive recording layer 3 comprises a leuco dye, a color developing/reducing agent, and a binder resin as its main constituents. It is a layer which reversibly repeats coloring/discoloring by heating. The leuco dye is referred to as an electron-donating dye precursor, which is usually colorless or light-colored. Furthermore, the color developing/reducing agent is called an electron-accepting compound, which causes a reversible color tone change of the leuco dye by altering a cooling speed after heating. As for this color developing/reducing agent, for instance, a phenolic compound, a naphthol compound, or a phthalic acid compound which include at least one aliphatic hydrocarbon group having six or more carbon atoms can, be used, or an acidic compound having a phenolic hydroxyl group and an amino group can be used, or an acidic compound having a naphthol hydroxyl group and an amino group can be used.

As for the leuco dye, which is contained in the reversible heat-sensitive recording layer 3 as one main component, the following can be used: Crystal Violet lactone, 3-indolino-3-p-dimethylaminophenyl-6-dimethylaminophthalide, 3-diethylamino-7-chlorofluoran, 2-(2-chlorophenylamine)-diethylaminofluoran, 2-(2-fluorophenylamino)-6-diethylaminofluoran, 2-(2-fluorophenylamino)-6-di-n-butylaminofluoran, 3-diethylamino-7-cyclohexylaminofluoran, 3-diethylamino-5-methyl-7-t-butylfluorarn, 3-diethylamino-6-methyl-7-anilinofluoran, 3-diethylamino-6-methyl-7-p-butylanilinofluoran, 3-cyclohexylamino-6-chlorofluoran, 2-anilino-3-methyl-6-(N-ethyl-p-toluidino)-fluoran, 3-pyrrolidino-6-methyl-7-anilinofluoran, 3-pyrrolidino-7-cyclohexylaminofluoran, 3-N-methylcyclohexylamino-6-methyl-7-anilinofluoran, 3-N-ethylpentylamino-6-methyl-7-anilinofluoran, etc.

In this case, the electron-donating dye precursor serving as the colorless/light colored leuco dye can be a compound of more than one or two kinds of it.

As for the color developing/reducing agent, which is contained in the reversible heat-sensitive recording layer 3 as one main component, the following can be used: N-(p-hydroxyphenyl)-N'-n-octadecylthiourea, N-(p-hydroxyphenyl)-N'-n-octadecylurea, N-(p-hydroxyphenyl)-N'-n-octadecylthioamide, 4'-octadecaneanilido, 2-octadecyltelephthalic acid, N-octadecyl(p-hydroxyphenyl) amide, N-(p-hydroxybenzoyl)-N-octadecanoylamine, N-[3-(p-hydroxyphenyl) propiono]-N'-octadecanohydrazide, N-[(p-hydroxyphenyl)methyl]-n-octadecylamide, N-[(p-hydroxyphenyl)methyl]-n-octadecylurea, N-[(p-hydroxyphenyl)methyl]-N'-n-octadecyloxamide, etc.

Furthermore, compounds expressed in the chemical formula shown below are other options for the color developing/reducing agent.

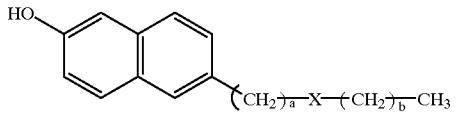

In this formula, 'a' is an integer between 1–3, X is one of the following groups; —CONH—, —NHCO—, —CONHCO—, —CONHNHCO—, and NHCOCONH—, and 'b' is an integer over 10.

In this case, the color developing/reducing agent can be a compound of more than one or two kinds of it.

With respect to a binder resin contained in the reversible heat-sensitive recording layer 3, specific examples are water-soluble macromolecules such as starches, hydroxyethyl cellulose, methyl cellulose, carboxymethyl cellulose, gelatin, casein, polyvinyl alcohol, modified polyvinyl alcohol, sodium polyacrylate, acrylamide-acrylic ester copolymer, acrylamide-acrylic ester-methacrylic ester terpolymer, alkali salts of styrene-maleic anhydride copolymer, alkali salts of ethylene-maleic anhydride copolymer, etc., and latices of polyvinyl acetate, polyurethane, polyacrylic ester, styrene-butadiene copolymer, acrylonitrile-butadiene copolymer, acrylic methyl-butadiene copolymer, ethylene-vinyl acetate copolymer, etc. In particular, a binder resin may be incorporated into the reversible heat-sensitive recording layer such that the reversible heat-sensitive recording layer is capable of superior dispersing of the electron-donating dye precursor (leuco (dye) and the electron accepting compound (color developing/reducing agent), thus becoming durable against rewriting actions. Therefore, it is possible to apply double bonding within molecules of the heat reversible resin to achieve an ultraviolet hardening or electron beam hardening resin. Specifically, it is possible to use a resin where acrylic acid and methacrylic acid are ester-polymerized to vinyl chloride-vinyl acetate-vinyl alcohol copolymer.

In the reversible heat sensitive recording layer 3, in order to carry out color development, it is appropriate that rapid cooling follows heating. On the other hand, slow cooling after heating causes achromatization. For example, when heating with an appropriate heat source such as a thermal head, laser beams, heat roll, heating stamp, high-frequency heater, hot air, electric heater, radiant heat from a light source such as a halogen lamp, etc. takes place for a comparatively long period of time, the cooling speed will decrease due the heating of the base material 11 etc., along with the reversible heat-sensitive recording layer 5, causing a state of phase separation, i.e. a state of achromatization, of the leuco dye and the color developing/reducing agent. On the other hand, by causing rapid cooling after heating by pressing a low temperature metal block and such, it is possible to bring about the color development.

Furthermore, when heating with a thermal head, laser beam, etc. takes place for an extremely short period of time, cooling (solidifing) will instantly follow after completion of heating, thus causing a state of color development. Therefore, with the application of the same heating temperature and/or heat source, color development and achromatization can be carried out arbitrarily by controlling the cooling speed. As to the heat-sensitive recording layer 3 using the above-mentioned materials, usually, the thickness of the heat sensitive recording layer is approximately 3–15 $\mu$m.

Figure 2:
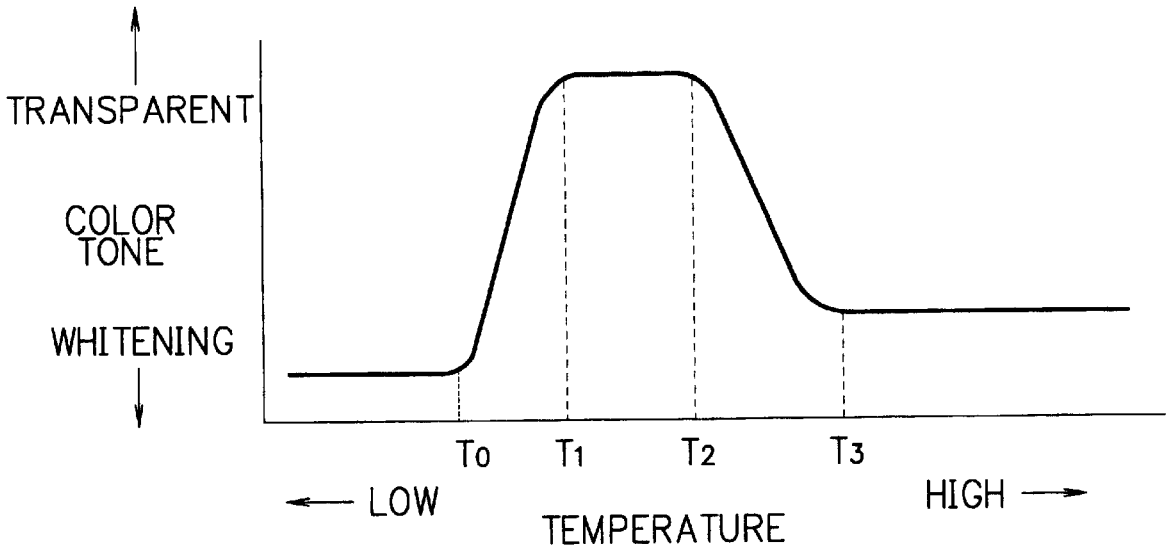
FIG. 2 is a diagram showing changes in state of a transparent-whitening type reversible heat-sensitive recording material.

As to other options for the reversible heat-sensitive recording layer 3, which has been described as being formed by the above-mentioned heat-sensitive recording materials, there are the ones as disclosed in Japanese Patent Laid-Open Publication No. 57-109695, Japanese Patent Laid-Open Publication No. 2-187389, etc. In the disclosures, the reversible heat-sensitive recording layer is formed by a resin such as a polyester, and a heat-sensitive recording material made of an organic low molecular substance being dispersed within the resin, i.e. a transparent-whitening type heat-sensitive recording material. With respect to this heat-sensitive recording material, the refraction ratio of the organic low molecular substance and the refraction ratio of the resin would become equal or different depending on the heating temperature being selected, causing the transparency to be altered reversibly. In other words, as it is shown in FIG. 2, when it is previously set to a whitening state at a temperature below T0 from which state the temperature is raised to T1–T2, as the temperature is cooled down to become below T0, the refraction ratio of the organic low molecular substance and the refraction ratio of the resin become substantially the same, which results in changing the state of transparency of the reversible heat-sensitive recording layer.

Furthermore, when heating this heat-sensitive recording layer to a temperature above T3, and then cooling down to become below temperature T0, the refraction ratio of the organic low molecular substance and the refraction ratio of the resin become different, causing light scattering, due to which the reversible heat-sensitive recording layer is changed to be in the whitening state again.

Moreover, when heating the reversible heat-sensitive recording layer to a temperature T0–T1 or temperature T2–T3, and then cooling down to become below temperature T0, the reversible heat-sensitive recording layer would be in a state between transparent and whitening. The reversible heat-sensitive recording material is capable of repeating such changes of state.

One example for the above-mentioned temperatures T0–T3 would be 60° C., 70° C., 80° C., and 110° C., respectively.

As for the resin to be used for reversible heat-sensitive recording material, it is preferred that the one with good transparency, superior mechanical strength and fine layer-forming characteristic is used. Specific examples are polyvinyl chloride, vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride, vinylidene chloride-vinyl chloride copolymer, vinylidene chloride-acrylonitrile copolymer, polyester resin, polyamide resin, acrylic resin, silicon resin, etc. Among these, the ones particularly suitable would be vinyl chloride-vinyl acetate copolymer, vinyl chloride-vinyl acetate-maleic acid copolymer, and polyester resin.

As for low molecular substance, the following are the options: alkanol, alkanediol, halogenatedalkanol or halogenatedalkandiol, alkylamine, alkane, alkene, alkyne, halogenatedalkan, halogenatedalkene, halogenatedalkyne, cycloalkane, cycloalkene, cycloalkyne, saturated or unsaturated mono-dicarboxylic acid or ester, amide or ammonium salt thereof, saturated or unsaturated halogenated fatty acid, or ester, amide or ammonium salt thereof, acrylic carboxylic acid or ester, amide or ammonium salt thereof, halogenated acrylic carboxylic acid or ester, amide or ammonium salt thereof, thioalcohol, thiocarboxylic acid or ester, amide or ammonium salt thereof, carboxylic ester of thioalcohol, etc., of which numbers of carbons are between 10–40, and molecular weights are between 100–700. The particularly preferable ones are those higher fatty acids including lauric acid, palmitic acid, stearic acid, arachic acid, behenic acid, etc., or ester amide or ammonium salt thereof, of which melting points are within a range of 50–150° C.

With respect to a mixture ratio of a resin and an organic low molecular substance, it is preferred that the range of weight ratio of the resin to the organic low molecular substance is in the range of 100 parts to 5–200 parts or more preferably 10–100 parts.

In the reversible heat-sensitive recording layer 3, in order to expand the temperature range of transparency, it is possible to have a resin with a glass transition point (Tg) lower than a resin base material incorporated when necessary. In this case, it is preferred that the glass transition point is below 50° C. The options for such resin are acrylic resin, polyester resin and polyamide resin.

Furthermore, in order to improve rewriting durability of the reversible heat-sensitive recording layer 3 against repeated printing/erasing, it is possible to have a radioactive ray hardening resin incorporated in the layer. The radioactive ray hardening resin is a kind of resin, which hardens by a radioactive ray such as ultraviolet, electron beam, etc. In this case, a coating including the radioactive ray hardening resin is applied, dried and then hardened by a radio active ray such as ultraviolet, electron beam, etc. Although there is no particular limits to the addition ratio of the radioactive ray hardening resin, it is preferred that the resin is of 0.1–50 weight parts when the resin base material is 100 weight parts. For instance, for this radioactive ray hardening resin, it is possible to use monoacrylate or diacrylate, acrylate or metacrylate having tetrahydrofuryl group, etc. of aliphatic group.

Intermediate Layer

To the reversible heat-sensitive recording sheet or the reversible heat-sensitive recording transfer sheet used in the present invention, it is possible to apply an intermediate layer in order to prevent any bad influence to the reversible heat-sensitive recording layer such as color development caused by the composing materials of the protective layer formed by a coating process, etc. applied later on. The intermediate layer is formed at a stage after the reversible heat-sensitive recording layer or the reversible heat-sensitive recording transfer layer is applied to through welding and before the protective layer is coated so as to be located in an outermost layer. With respect to the reversible heat-sensitive recording sheet, such intermediate layer should be provided on the surface of the reversible heat-sensitive recording layer, and with respect to the reversible heat-sensitive recording transfer sheet, it should be provided in between the reversible heat-sensitive recording layer and the separating layer.

For instance, this kind of intermediate layer is formed using ultraviolet hardening resin. For this ultraviolet hardening resin, acrylic resin, polyester resin, etc., can be used. Furthermore, it is also possible to use known materials having been used as a protective layer in the prior art.

For example, the thickness of an intermediate layer 31 is about 0.5–1 $\mu$m, although there is no particular limits to it.

Furthermore, the reversible heat-sensitive recording sheet or the reversible heat-sensitive recording transfer sheet which is not provided with such intermediate layer can have the intermediate sheet formed after the reversible heat-sensitive recording sheet or the reversible heat-sensitive recording transfer sheet and the substrate sheet is adhered to each other through welding, and before the protective layer is formed.

In case when a solvent is used in forming such intermediate layer, the solvent should not interfere with the reversible heat-sensitive recording layer 3. For instance, the options are water, aromatic hydrocarbon such as toluene and xylene, etc., cycloalkane such as cyclohexane, aliphatic hydrocarbon such as n-hexane, and other hydrocarbon solvents with comparatively weak polarity. Monomer, oligomer, etc. contained in the ultraviolet hardening resin for forming the intermediate layer can sometimes function as a solvent.

With respect to a coating means, gravure coater, bar coater, knife coater, etc. can be used. In this way, by forming the intermediate layer by coating, no pin hole will be produced, and therefore, it is not necessary to worry about any color developing or achromatization on the reversible heat-sensitive recording layer 3.

Concealing Layer 32

When separating the reversible heat-sensitive recording sheet 2A or the reversible heat-sensitive recording transfer sheet 2B by forming a slit, the leuco dye, etc. contained in the reversible heat-sensitive recording layer 3 can stick to the adhesive layer 4, which may cause irreversible coloring on the adhesive layer 4 after the adhesive layer 4 is welded. A concealing layer 32 is provided to conceal such irreversible coloring on the adhesive layer 4. It is preferred that the concealing layer 32 is located somewhere between the adhesive layer 4 and the reversible heat-sensitive layer 3. As previously mentioned, the concealing layer 32 is provided for the purpose of improving visibility of the information recorded on the reversible heat-sensitive recording layer by concealing inappropriate coloring. Therefore, as to its structure, it should not be limited to the above-mentioned structure, but should take any appropriate form suitable for serving its purpose as discussed above.

Accordingly, for an embodiment of such concealing layer 32, there are several cases including, for instance, a case in which the concealing layer 32 is formed by coloring using metallic particles such as aluminum paste, etc., metallic oxide particles such as titanium oxide, etc., a case in which the adhesive layer 4 and the concealing layer 32 as shown separated in FIG. 1A and FIG. 2B are combined with respect to their functions in order to form a concealing adhesive layer, a case in which a second barrier layer is formed as the concealing layer 32 in order to form a metallic vapor deposition layer for concealing the above-mentioned irreversible color development on the barrier layer, etc.

Now with respect to the metallic particles contained in the concealing layer 32 and the concealing adhesive layer, the options are aluminum, zinc, copper, etc., and with respect to the metallic oxide particles, the options are titanium oxide, zinc oxide, etc. These particles can be used as being dispersed in the resin solvent, as they form the concealing layer by coating. On the other hand, in case when using the metallic vapor deposition layer as the concealing layer, the concealing layer is formed by vapor deposition of aluminum, zinc, copper, nickel, gold, silver, or tin, etc.

Barrier Layer 33

In case when the concealing layer 32 contains metallic particles or metallic oxide particles, the reversible heat-sensitive recording layer 3 can have undesirable color development due to the solvent and resin components used in the coating for the concealing layer 32, or due to the solvent and resin components used in the coating for the adhesive layer 4. A barrier layer 33 is provided for preventing such undesirable color development. Furthermore, when the concealing layer 32 is a metallic vapor deposition layer, the concealing layer 32 can be damaged by corrosion due to the resin contained in the adhesive layer 4 having many polar groups, or due to the color developing/reducing agent, etc. contained in the reversible heat-sensitive recording layer 3 having acid groups. In this respect, the barrier layer 33 is provided for preventing the concealing layer 32 from such damage due to corrosion. In this case, it is preferred that the barrier layer 33 is formed by coating ultraviolet hardening resin coating. The barrier layer 33 can be placed in between the concealing layer 32 and the reversible heat-sensitive recording layer 3, or in between the adhesive layer 4 and the reversible heat-sensitive recording layer 3, etc.

Other Layers

As to other layers, for example, it is possible to have a layer made of ultraviolet hardening resin coating, which has been described as forming the barrier layer, containing metallic particles or metallic oxide particles, formed in between the reversible heat-sensitive recording layer and the adhesive layer.

Doing so, it is possible to prevent any unnecessary color developing on the reversible heat-sensitive recording layer due to the resin with many polar groups contained in the adhesive layer. Furthermore, it is possible to prevent irreversible coloring due to the leuco dye sticking on the adhesive layer being heated and pressured. What is more, the coating process will be simplified.

By laminating each of the above-mentioned layers, it is possible to obtain the above-mentioned reversible heat-sensitive recording sheet 2A, and the reversible heat-sensitive recording transfer sheet 2B. The above-mentioned reversible heat-sensitive recording sheet 2A and the reversible heat-sensitive recording transfer sheet 2B can be manufactured by known methods.

Other Recording Layers

According to the present invention, other recording layers can be applied to the reversible heat-sensitive recording sheet 2A or the reversible heat-sensitive recording transfer sheet 2B. For example, for such recording layer, a magnetic recording layer, which will be described in the following, can be used.

As to the magnetic recording layer, the ones typically used in conventional magnetic recording mediums can be the options. For example, as a magnetic material, Ba-ferrite, Sr-ferrite, Co adherent $\gamma$-$Fe_2O_3$, $\gamma$-$Fe_2O_3$, acicular iron powder, $C_rO_2$, etc., with particle diameters below 10 $\mu$m, preferably between 0.01–5 $\mu$m, can be used, and as a binder resin, polyester resin, alkyd resin, vinyl resin, polyuretan resin, or mixed resin thereof can be used. Furthermore, the magnetic recording layer 14 can contain other additive agent. The additive agent can be for instance, antistatic agent, surface active agent, dispersing agent, plasticizer, lubricant, etc. The thickness of the magnetic recording layer should be about 5–20 $\mu$m.

As described above, by appropriately laminating each of the above-mentioned layers on the base material, it is possible to obtain the above-mentioned reversible heat-sensitive recording sheet or the reversible heat-sensitive recording transfer sheet used in the present invention. For there is no particular limitations to the laminating method, it is possible to use the conventionally known method.

Separating Layer

The separating layer 6 of the reversible heat-sensitive recording transfer sheet 2B as shown in FIG. 1B is provided for improving the separating characteristic in the portion between the sheet base material 20 and the reversible heat-sensitive recording layer 3. Therefore, the separating layer 6 can be a coating layer made of a coating agent in which a separating agent such as fluoro resin, a type of wax, silicone, etc. is added, for example to a vehicle such as acrylic resin, cellulose resin, vinyl resin, etc. The separating layer can also be a coating layer or an extrusion coat layer, etc. made of a coating agent of separating resin such as fluoro resin, silicon, melamine resin, polyolefine resin, multifunctional acrylate resin of an ionizing radiation bridging type, polyester resin, epoxy resin, etc.

Base Material or Sheet Base Material

For the base material 15 shown in FIG. 1A, and the sheet base material 20 shown in FIG. 1B, for instance, synthetic resin sheet or synthetic paper such as polyethylene terephthalate (PET), polyacetate, polystyrene (PS), epoxy resin, polyvinyl chloride (PVC), polycarbonate (PC), etc. can be used. The thickness of the base material 15 or the sheet base material 20 should usually be about 10–50 μm.

Figure 3A:
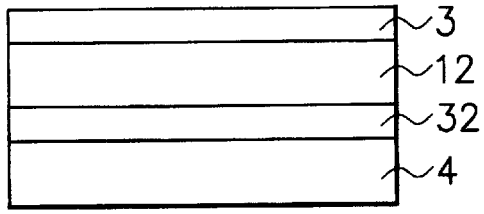
FIG. 3A is a sectional schematic view showing another laminating structure of a reversible heat-sensitive recording sheet used in the present invention.
Figure 3B:
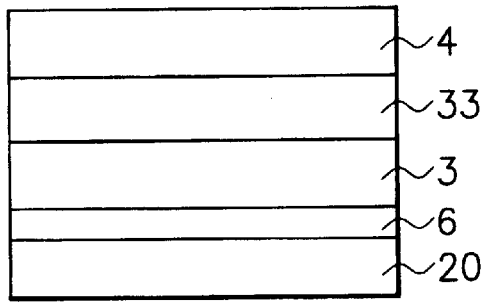
FIG. 3B is a sectional schematic view showing another laminating structure of a reversible heat-sensitive recording transfer sheet used in the present invention.
Figure 3C:
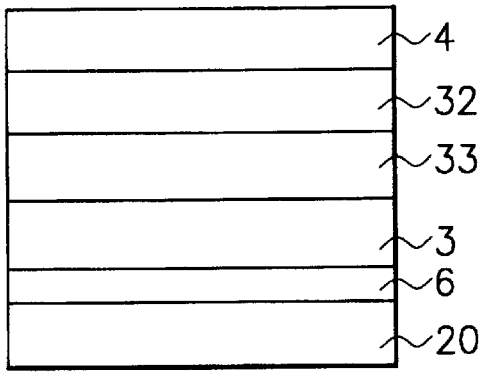
FIG. 3C is a sectional schematic view showing another laminating structure of a reversible heat-sensitive recording transfer sheet used in the present invention.

Laminating Example of Reversible Heat-Sensitive Recording Sheet and Reversible Heat-Sensitive Recording Transfer Sheet For one of other examples for laminating the reversible heat-sensitive recording sheet, for instance, a laminating structure in FIG. 3A is in the order of adhesive layer 4, concealing layer 32, base material 12, and reversible heat-sensitive recording layer 3. Furthermore, for one of other examples for laminating the reversible heat-sensitive recording transfer sheet, for instance, a laminating structure in FIG. 3B is in the order of sheet base material 20, separating layer 6, reversible heat-sensitive recording layer 3, barrier layer 33, and adhesive layer 4. Another example for the laminating structure is shown in FIG. 3C, in which laminating is in the order of sheet base material 20, separating layer 6, reversible heat-sensitive recording layer 3, barrier layer 33, concealing layer 32, and adhesive layer 4.

Protective Layer

The protective layer 1 used in the present invention should contain ultraviolet hardening resin and porous filler, and it is preferred that it is formed by a protective layer forming resin including porous filler of an average particle diameter being 0.7–2.5 times thicker than the protective layer 1. If porous filler of a particle diameter smaller than the thickness of the protective layer 1 is used in such protective layer forming resin, the porous filler in the protective layer forming resin will all sink, causing a loss of a self-cleaning characteristic.

As to the porous filler, it is typical that filler expressed in an average particle diameter is used, and therefore, even when filler of an average particle diameter which is smaller than the thickness of the protective layer 1 is used, this filler would contain filler larger than the thickness of the protective layer 1. In other words, with respect to the protective layer 1 used in the present invention, it is sufficient enough that a moderate unevenness can be provided on the surface of the protective layer 1, and therefore, it is possible to use porous filler with a small particle diameter smaller than the thickness of the protective layer 1. Furthermore, for example, it is also possible to use hollow filler with a specific gravity smaller than the ultraviolet hardening resin. It is further possible to use a mixture of the porous filler and the hollow filler.

In this case, organic high polymer filler of a particle diameter smaller than the thickness of the protective layer can also be used in an suitable manner.

For such organic high polymer filler, the one with a particle diameter similar to the above-mentioned porous filler is sued. Consequently, it is possible to obtain a protective layer having the same kind to effects as discussed above. Therefore, it is necessary that the porous filler or the organic high polymer filler is selected on the basis of the thickness of the paint film of the protective layer 1, and that the particle diameter of the porous filler and the organic high polymer filler is 0.7–2.5 times as thick as the thickness of the protective layer 1. In case when it is desired to prevent sandy texture on the surface of the protective layer 1, it is preferred that a particle diameter is set to 0.7–2.0 times of the thickness of the protective layer 1.

The roughness of the surface of the protective layer 1 (i.e. the surface touching the thermal head, etc.), is Ra (μm) which is prescribed by JISB0601, and it is preferred that it is within the range of 0.10–0.60 μm. In this way, it is possible to obtain a suitable unevenness on the surface of the protective layer 1.

With respect to the weight ratio of the porous filler and the organic high polymer filler within the protective layer 1, the weight ratio suitable for cleaning the smudges on the thermal head caused by the porous filler, and for preventing unevenness provided on the surface of the protective layer 1 from vanishing due to the elasticity of the organic high polymer filler when repeating printing and erasing of characters is: porous filler: organic high polymer filler=1:9–9:1.

The porous filler and organic high polymer filler content in the protective layer 1 in terms of a solid portion ratio should be 0.5–10 weight parts with respect to 100 weight parts of the ultraviolet hardening resin contained in the protective layer 1. When the content is 0.5–10 weight parts in terms of a solid portion ratio, there would not be such distinctive difference caused in the primary density and the surface characteristic. On the other hand, when filler content is more than 10 weight parts, the delustering effect would be too high to cause deteriorated visibility, and deteriorated contrast accompanying deterioration of the primary density. Furthermore, when the content of the porous filler and the organic high polymer filler increases, the hardness of the protective layer 1 is deteriorated due to the reduction of the ultraviolet hardening resin, causing a reduced durability of the protective layer 1 to become easily damaged by scratches, etc., which is not suitable.

Furthermore, for the organic high polymer filler, stylene, acrylate, benzo guanamine, melamine, silicone, or copolymer thereof, or condensation product thereof can be used.

Since the refraction ratio of the ultraviolet hardening resin included in the protective layer 1 should be in the range of 1.45–1.55, it is preferred that the refraction ratio of the porous filler should be in the range of 1.30–1.65. By mixing porous filler to the ultraviolet hardening layer having small difference of refraction ratio with respect to that of the ultraviolet hardening resin, it is possible to have the reflection density of printing unchanged, and have a delustering effect that increases lightness accompanied by a decrease in glossiness. Consequently, it is possible to improve the visibility of printed characters, which are made uneasy to see due to glaring.

With respect to the porous filler, porous silica (refraction ratio of 1.46), porous diatomite powder (refraction ratio of 1.52–1.55), etc., can be used. They can be used in combination as well.

The protective lazyer forming material for forming the protective layer 1 further includes photopolymerization initiator, sensitizer, silicon oil and stabilizer, etc. The quantity of the above agents can be appropriately used within the range known in the prior art.

Furthermore, the pH of the porous filler contained in the protective layer 1 within the reversible heat-sensitive recording medium of the present embodiment should preferably in the range of 6.0–8.0. By selecting such porous filler having such figure for its pH, it is possible to prevent undesirable color development due to the filler reacting to the leuco dye contained in the reversible heat-sensitive recording layer 3.

In other words, when the porous filler is basic with high pH, the protective layer 1 will be exposed to coloring with a light red color due to decomposing of the leuco dye contained in the reversible heats-sensitive recording layer 3. On the other hand, when the porous filler is acidic with low pH, there is a tendency that the porous filler and the leuco dye contained in the reversible heat-sensitive recording layer 3 react with each other to cause irreversible coloring. In this respect, in the present embodiment, the porous filler with pH within the range of 6.0–8.0 can be used. In the present embodiment, in case of having an intermediate layer provided between the reversible heat-sensitive recording layer and the protective layer, it is also possible to have pH surpassing the above-mentioned figure.

The pH of the porous filler in the present invention is measured with the porous filler in a 5% slurry state, the porous filler of 5 weight percentage being slurried in water.

Therefore, in accordance with the present invention, in the protective layer 1, by mixing such porous filler, etc. as discussed above into the ultraviolet hardening resin, dirt on the reversible heat-sensitive recording medium are adsorbed to the porous filler, by which it is possible to prevent any dirt from attaching to the thermal head. In this case, it is preferred that the ultraviolet hardening resin is a kind used as a hard coating agent.

Furthermore, by using such porous filler, it is possible to prevent the printed characters from becoming fainted, or any occurrence of sticking at the time of printing recycle. Accordingly, trouble for cleaning the thermal head can be eliminated, which is advantageous. In addition, since the pH of the porous filler is adjusted to be in the range of 6.0–8.0, the reaction between the porous filler and the leuco dye contained in the reversible heat-sensitive recording layer can be controlled to prevent any unnecessary coloring on the reversible heat-sensitive recording layer 3.

Furthermore, it is preferred that the porous filler (silica, etc.) content of the protective layer 1 is 0.5–10 weight parts with respect to the ultraviolet hardening resin of 100 weight parts. When the content is 0.5–10 weight parts in terms of a solid portion ratio, physical strength of the protective layer 1 will be maintained. In case when the content is larger than 10 weight parts, physical strength of the protective layer 1 will be decreased to reduce its durability, which is undesirable. In case when the filler content is smaller than the figure discussed above, there are possibilities that dirt attaching on the thermal head cannot be prevented.

In order to produce sufficient hardness for the protective layer forming resin, the ultraviolet hardening resin is added. Furthermore it is further possible to add fine silica such as fiumed silica to the protective layer 1 in order to form suitable unevenness on the surface of the protective layer 1, to prevent glaring on the surface of the protective layer 1, to prevent occurrence of scratches on the surface of the protective layer 1, and to give self cleaning characteristic to the thermal head.

Substrate Sheet

With respect to the substrate sheet 5 used in the manufacturing method of the present invention, it is possible to use, for instance, the following materials:

Chlorinated polymer; polyvinyl chloride, vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride, vinylidene chloride-vinyl chloride copolymer, vinylidene chloride-acrylonitrile copolymer, etc.

Polyester resin; polyethylene telephthalate resin, polybutylene telephthalate resin, condensed ester resin (eg. PETG by Eastman Chemical Company) of an acid component such as telephtalic acid or isophthalic acid and an alcohol component such as ethylene glycol or cyclohexane dimethanol, etc.

Biodegradation plastic resin; poly lactic acid resin, natural high polymer made of starch and denaturated polyvinyl alcohol, etc., resin of microbial product made of β-hydroxy butyric acid and β-hydroxy valeric acid, etc.

Furthermore, other options are polyamide, acrylic, silicone, etc., and it is also possible to appropriately combine the above materials.

One example of laminating would be that two laminated white-color polyvinyl chloride resin sheets, for instance with a thickness of 280 μm, having prints, etc. on the surface are used as a core sheet where transparent polyvinyl chloride resin sheet, for instance with a thickness of 100 μm is laminated as an over sheet on its face and back surfaces. Another example of laminating would be that two laminated white color PETG sheets, for instance with a thickness of 280 μm, having prints, etc. on tie surface are used as a core sheet where transparent PETG sheet, for instance with a thickness of 100 μm is laminated as an over sheet on its face and back surfaces.

In accordance with a manufacturing method of the reversible heat-sensitive recording medium of the present invention, first, the reversible heat-sensitive recording sheet 2A or the reversible heat-sensitive recording transfer sheet 2B is mounted on the substrate sheet 5 through welding. Furthermore, it is possible to weld the reversible heat-sensitive recording sheet 2A or the reversible heat-sensitive recording transfer sheet 2B to the substrate sheet 5 after forming a slit of a predetermined shape.

Welding

The welding process applied to the reversible heat-sensitive recording sheet 2A and the substrate sheet 5 is conducted by firstly applying heat adhesion followed by heat lamination. Furthermore, the welding process can be executed by applying heat transfer to the reversible heat-sensitive recording transfer sheet 2B and the substrate sheet 5, followed by heat lamination. Such heat adhesion and heat transfer can be executed by a known method such as pressing a rubber roll, etc. Then the welding process is completed by applying heat lamination. The heat adhesion and heat transfer discussed above are normally executed within a temperature range of 90–130° C.

The above-mentioned heat lamination can be applied by a heat pressing machine under a condition of 10–50 kg/cm$^2$ pressure, preferably of 15–40 kg/cm$^2$ pressure, at a temperature of 100–170° C., preferably of 110–150° C. As to the temperature at the time of heating, appropriate range of temperature should be decided and selected on the basis of the type and material of the substrate sheet, which are discussed above.

For example, when using a layered product such as transparent polyvinyl chloride sheet/white-color polyvinyl chloride sheet/white-color polyvinyl chloride sheet/transparent polyvinyl chloride sheet as a substrate sheet, the temperature at the time of heat lamination should preferably be in the range of about 130–150° C. On the other hand, when using a layered product such as transparent PETG/ white-color PETG/white-color PETG/transparent PETG as a substrate sheet, the temperature at the time of heat lamination should be in the range of about 110–130° C.

When the pressure and the heating temperature at the time of applying heat lamination surpasses the above-mentioned range of temperature, the obtained welded product will become of a wavy shape, or the thickness will be below the prescribed value, and therefore, there will be possibilities that the performance exhibited is not sufficient, which is not a desirable condition. Furthermore, when the pressure and the heating temperature at the time of welding is less than the above-mentioned range of temperature, the pasting will be applied with insufficient strength, which is not desirable either.

This kind of he,at lamination can be executed by other methods, but the condition of pressure and temperature for the heat lamination should be the same as discussed above. In case of obtaining the welded product using the reversible heat-sensitive recording transfer sheet, the sheet base material 20 is to be separated after the heat transfer, which is followed by the heat lamination. The separation of the sheet base material 20 should be done before the protective layer is formed. For instance, in case of heat transferring the reversible heat-sensitive recording transfer sheet 2B is on the entire surface of the substrate sheet 5, the sheet base material 20 can be separated after the welding.

Forming Protective Layer

The protective layer is formed in the thickness of 1–5 μm, preferably in the thickness of 2–4 μm, by coating the protective layer forming resin on the reversible heat-sensitive recording layer 3 of the welded product obtained through welding.

In this case, the average particle diameter of the porous filler used in the protective layer should preferably be 0.7–12.5 μm, or can be about 1.4–10 μm.

Such coating process is executed by a method known in the prior art, and there is no particular limitation set to the coating method. For example, it is possible to use a coating method such as gravure coating, bar coating, knife coating, reverse coating, etc. In this case, the protective layer 1 is provided at least on the surface where the reversible heat-sensitive recording layer 3 is provided. When the reversible heat-sensitive recording layer 3 is provided only on a part of the substrate sheet 5, the protective layer can be provided only on the part where the reversible heat sensitive-recording layer 3 is provided on the substrate sheet 5. Alternatively, the protective layer 1 can be provided on the entire surface of the substrate sheet covering the reversible heat-sensitive recording layer. Since the protective layer 1 has a thickness of about 1–5 μm, it would not cause any unattractiveness even if it is formed on a part of the substrate sheet. Furthermore, it will not be necessary to worry about any glaring on the protective layer or any difficulty due to its being stuck in use.

After that, by irradiating ultraviolet, etc. in accordance with the conventional method, forming of the protective layer will come to completion due to its being hardened.

The roughness of the surface of the protective layer obtained in this way should be within the range of Ra value prescribed by JIS B 0601, and it should preferably be within the range of 0.10–0.60 μm, or more suitably within the range of 0.20–0.40 μm.

After the protective layer is formed on the reversible heat-sensitive recording layer of the welded product in the above-described manner, a card with a certain predetermined size is formed by punching, etc., which is a known method in the prior art.

Next, the manufacturing method of the reversible heat-sensitive recording medium of the present invention and the reversible heat-sensitive recording medium being manufactured by this method will be described in more detail with reference to the drawings. The present invention is not to be limitedly interpreted by those examples.

EXAMPLE 1

Figure 4A:
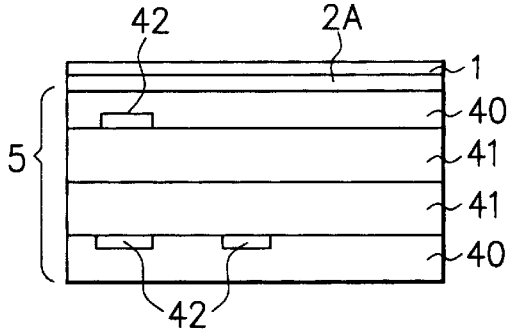
FIG. 4A is a sectional schematic view showing an example of a reversible heat-sensitive recording medium manufactured as a card using the reversible heat-sensitive recording sheet made by the manufacturing method of the present invention, as the reversible heat-sensitive recording sheet is applied to the entire surface of a substrate sheet.

Using the reversible heat-sensitive recording sheet 2A as shown in FIG. 1A, a reversible heat-sensitive recording medium 10 as shown in FIG. 4A is manufactured. The composition of each layer of the reversible heat-sensitive recording sheet 2A, and a process of manufacturing the reversible heat-sensitive recording sheet to be applied to a card, etc. will be described in the following.

Forming Reversible Heat-Sensitive Recording Sheet 2A

1. Base Material 12

Transparent polyethylene telephthalete (PET. produced by Toyobo Co., Ltd., name of product E5100) of a thickness of 25 μm is prepared.

2. Reversible Heat-Sensitive Recording Layer 3

Materials for composition shown below are put in a container, where zirconia beads with a 2 mm diameter are added. Then this is dispersed for 60 minutes by a paint shaker, in order to manufacture a coating. This coating is applied to the surface of the base material 12 with a #26 wire bar, dried (at 80° C., for 5 minutes), put under ultraviolet irradiation (160W/cm, 30 m/min, 1 pass), so as to form a reversible heat-sensitive recording layer 3 of a dried layer thickness of 6 μm.

| | |
|---|---|
| Leuco dye (3-diethylamino-6-methyl-7-anilino-fluoran, produced by Yamamoto Chemical Co., Ltd., name of product ODB) | 20 weight parts |
| Color developing/reducing agent (N-(4-hydroxy-phenyl)-N'-n-octadecylurea, Japanese Patent Laid-Open Publication No. 6-210954) | 60 weight parts |
| Heat reversible resin (acrylic resin produced by Mitsubishi Rayon Co., Ltd., name of product Dianal BR-80) | 60 weight parts |
| Ultraviolet hardening resin (produced by BASF Co., Ltd., name of product LAROMER LR8864) | 20 weight parts |
| Photopolymerization initiator (produced by Ciba Specialty Chemicals Co., Ltd., name of product DAROCUR 1173) | 1 weight part |
| Solvent (MEK: toluene = 1:1) | 1000 weight parts |

3. Adhesive Layer

A coating composed with materials shown below is coated using a #10 wire bar on the surface of the base material 12 opposite to the surface where the reversible heat-sensitive recording layer 3 is provided, dried (at 80° C., for 5 minutes), so as to form an adhesive layer of a dried layer thickness of 3 μm.

| | |
|---|---|
| Deformed ethanol polyester adhesive (produced by Fuji Photo Film Co., Ltd., name of product Stafix SOC-30-M, 30% solid portion) | 2 weight parts |
| Solvent (MEK: toluene = 1:1) | 1 weight part |

In this way, the reversible heat-sensitive recording sheet 2A is formed.

Next, the reversible heat-sensitive recording sheet 2A with the above-mentioned structure is welded to the substrate sheet 5 in the following manner. As to the substrate sheet 5, a layered product of transparent rigid polyvinyl chloride sheet/white color rigid polyvinyl chloride sheet/white color rigid polyvinyl chloride sheet/transparent rigid polyvinyl chloride sheet is used.

Welding

Welding is executed by heat adhesion and subsequent heat lamination.

1. Heat Adhesion

On the reversible heat-sensitive recording sheet having the above structure, the transparent rigid polyvinyl chloride sheet with a thickness of 100 μm is attached by pressing a rubber role heated to 100° C. A magnetic tape is separately adhered to in the same manner.

2. Heat Lamination

Transparent rigid polyvinyl chloride sheets where the reversible heat-sensitive recording layer 3 is formed, a white-color rigid polyvinyl chloride sheet of a thickness of 280 μm having print 42 applied thereon, and a transparent rigid polyvinyl chloride sheet of a thickness of 100 μm are piled on top of each other, and heat-pressed by a heat pressing machine at a temperature of 135° C. under pressure of 50 kg/cm$^2$ for 10 minutes. At this point, on measuring the surface roughness of the reversible heat-sensitive recording layer as a welded product, the roughness becomes Ra=0.03 μm.

Forming Protective Layer 1

On the entire surface of the reversible heat-sensitive recording layer 3 as a welded product obtained in this way, a protective layer forming resin is coated as described below, after which ultraviolet is irradiated to form a protective layer 1.

Protective Layer Forming Resin

Materials for composition shown below are put in a container, where zirconia beads with a 2 mm diameter are added. Then this is dispersed for 10 minutes by a paint shaker in order to manufacture a coating. This coating is applied to the reversible heat-sensitive recording layer 3 with a #4 wire bar, dried (at 60° C., for 10 minutes), put under ultraviolet irradiation (160W/cm, 30 m/min, 1 pass), so as to form a protective layer of a dried layer thickness of 2 μm. At this point, on measuring the surface roughness of the protective layer, the roughness becomes Ra=0.28 μm.

| | |
|---|---|
| Ultraviolet hardening coating (produced by Dainippon Ink and Chemicals Incorporated, name of product Unidick 17-806, 80% solid portion) | 100 weight parts |
| Silica (produced by Fuji Silysia Chemical Ltd., name of product Sylysia 436) | 5 weight parts |
| Silicone oil (produced by Shin-Etsu Chemical Co., Ltd., name of product KF 96) | 3 weight parts |
| Solvent (MEK: toluene = 1:1) | 150 weight parts |

Punching

The welded prod-act where the protective layer 1 is formed on the reversible heat-sensitive recording layer 3 is punched by a metal mold to have an external form prescribed by JISX6301 in order to manufacture a card of the reversible heat-sensitive recording medium 10 having a specific protective layer 1.

EXAMPLE 2

Figure 4B:
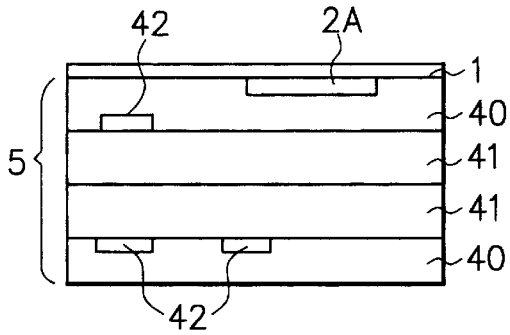
FIG. 4B is a sectional schematic view showing an example of a reversible heat-sensitive recording medium manufactured as a card using the reversible heat-sensitive recording sheet made by the manufacturing method of the present invention, as the reversible heat-sensitive recording sheet is applied to a part of the surface of a substrate sheet.

In this example, instead of the reversible heat-sensitive recording sheet 2A used in Example 1, a reversible heat-sensitive recording sheet as shown in FIG. 3A having a concealing layer as described below provided between a base material 12 and an adhesive layer 4 is used. This reversible heat-sensitive recording sheet is slit into a tape shape according to a slit formation described below, and this tape shaped reversible heat-sensitive recording sheet and the substrate sheet are attached to each other through welding. The rest of the process is the same as that of Example 1, resulting in forming a card of reversible heat-sensitive recording medium shown in FIG. 4B.

Concealing Layer

Materials for composition shown below are agitated by an agitator for 30 minutes to manufacture a coating. This coating is applied to the rear surface of the base material 25 with a #10 wire bar, dried (at 80° C., for 5 minutes), so as to form a concealing layer of a dried layer thickness of 3 μm.

| | |
|---|---|
| Aluminum paste (produced by Asahi Chemical Industry Co., Ltd., name of product MH8803) | 9 weight parts |
| Vinyl chloride - vinyl acetate - maleic anhydride copolymer (produced by Unioncarbide Co., Ltd., name of product VMCH) | 11 weight parts |
| Solvent (MEK: toluene = 1:1) | 40 weight parts |

Forming Slit

In order to separate in a desirable width, a slit is formed on the reversible heat-sensitive recording sheet 2A to make a reversible heat-sensitive recording tape.

COMPARISON EXAMPLE 1

A card of a reversible heat-sensitive recording medium is manufactured in the same manner as in Example 1, except that a reversible heat-sensitive recording sheet with a protective layer of a 2 μm thickness previously being provided is used instead of the one used in Example 1.

EXAMPLE 3

Figure 4C:
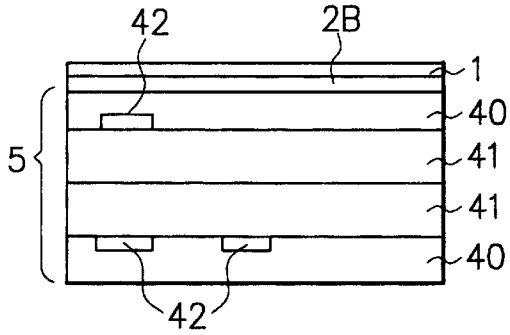
FIG. 4C is a sectional schematic view showing an example of a reversible heat-sensitive recording medium manufactured as a card using the reversible heat-sensitive recording transfer sheet made by the manufacturing method of the present invention, as the reversible heat-sensitive recording sheet is applied to the entire surface of a substrate sheet.

As shown in FIG. 3A, a reversible heat-sensitive recording medium 10 is manufactured using a reversible heat-sensitive recording transfer sheet 2B shown in FIG. 4C. The composition of each layer of this reversible heat-sensitive recording transfer sheet 2B, and a process of manufacturing the reversible heat-sensitive recording transfer medium to be applied to a card, etc. will be described in the following.

Forming Reversible Heat-Sensitive Recording Transfer Sheet 2B

1. Sheet Base Material 20

Transparent polyethylene telephthalete (PET. produced by Toyobo Co., Ltd., name of product E5100) of a thickness of 25 μm is prepared.

2. Separating Layer 6

Materials for composition shown below are coated on the surface of the base material 17 using a #4 wire bar, and dried (at 120° C., for 2 minutes), so as to form a separating layer 6.

| | |
|---|---|
| Silicone resin (produced by Shin-Etsu Chemical Co., Ltd., name of product KS-882) | 40 weight parts |
| Polyvinyl-butyral resin (produced by Sekisui Chemical Co., Ltd., name of product BL-1) | 4 weight parts |
| Hardener (Shin-Etsu Chemical Co., Ltd., name of product CAT-PS-80) | 1 weight part |
| Solvent (methyl ethyl ketone (MEK): toluene = 1:1) | 600 weight parts |

3. Reversible Heat-Sensitive Recording Layer 3

Materials for composition shown below are put in a container, where zirconia beads with a 2 mm diameter are added. Then this is dispersed for 60 minutes by a paint shaker, in order to manufacture a coating. This coating is applied to the surface of the separating layer 6 with a #26 wire bar, dried (at 80° C., for 5 minutes), put under ultraviolet irradiation (160W/cm, 25 m/min, 1 pass), so as to form a reversible heat-sensitive recording layer 3 of a dried layer thickness of 6 μm.

| | |
|---|---|
| Leuco dye (3-diethylamino-6-methyl-7-anilino-fluoran, produced by Yamamoto Chemical Co., Ltd., name of product ODB) | 20 weight parts |
| Color developing/reducing agent (N-(4-hydroxy-phenyl)-N'-n-octadecylurea, Japanese Patent Laid-Open Publication No. 6-210954) | 60 weight parts |
| Heat reversible resin (acrylic resin produced by Mitsubishi Rayon Co., Ltd., name of product Dianal BR-80) | 60 weight parts |
| Ultraviolet hardening resin (produced by BASF Co., Ltd., name of product LAROMER LR8864) | 20 weight parts |
| Photopolymerization initiator (produced by Ciba Specialty Chemicals Co., Ltd., name of product DAROCUR 1173) | 1 weight part |
| Solvent (MEK: toluene = 1:1) | 1000 weight parts |

2. Barrier Layer

A coating composed with materials shown below is coated using a #20 wire bar on the reversible heat-sensitive recording layer 3, dried (at 80° C., for 5 minutes), put under ultraviolet irradiation (160W/cm, 25 m/min, 1 pass), so as to form a barrier layer 4 of a dried layer thickness of 10 μm.

| | |
|---|---|
| Ultraviolet hardening coating (produced by Dainippon Ink and Chemicals Incorporated, name of product Unidick C3-374 | 1 weight part |
| Solvent (toluene) | 1 weight part |

3. Adhesive Layer 4

A coating composed with materials shown below is coated on the barrier layer using a #10 wire bar, dried (at 80° C., for 5 minutes), so as to form an adhesive layer of a dried layer thickness of 3 μm.

| | |
|---|---|
| Deformed ethanol polyester adhesive (produced by Fuji Photo Film Co., Ltd., name of product Stafix SOC-30-M | 2 weight parts |
| Solvent (methyl ethyl ketone: toluene = 1:1) | 1 weight part |

Welding

Next, the reversible heat-sensitive recording transfer sheet 2B is heat-transferred to the substrate sheet 5, and then heat-pasted to the substrate sheet 5, after having the sheet base material 20 being separated. As to the substrate sheet 5, a layered product of transparent rigid polyvinyl chloride sheet/white color rigid polyvinyl chloride sheet/white color rigid polyvinyl chloride sheet/transparent rigid polyvinyl chloride sheet is used. In this way, when using reversible heat-sensitive recording transfer sheet, welding is executed by heat transfer and the following heat lamination.

1. Heat Transfer

To the reversible heat-sensitive recording transfer sheet 2B having the above structure, the transparent rigid polyvinyl chloride sheet with a thickness of 100 μm is transferred by pressing a rubber role heated to 100° C. A magnetic tape is separately adhered to in the same manner.

2. Heat Lamination

Transparent rigid polyvinyl chloride sheets where the reversible heat-sensitive recording layer 3 is formed as above, a white-color rigid polyvinyl chloride sheet of a thickness of 280 μm having print 42 applied thereon, and a transparent rigid polyvinyl chloride sheet of a thickness of 100 μm are piled on top of each other, and heat-pressed by a heat pressing machine at a temperature of 135° C. under pressure of 50 kg/cm$^2$ for 10 minutes. At this point, on measuring the surface roughness of the reversible heat-sensitive recording layer, the roughness becomes Ra=0.02 μm.

Forming Protective Layer 1

On the entire surface of the reversible heat-sensitive recording layer 3 as a welded product obtained in this way, a protective layer forming resin as described below is applied to the reversible heat-sensitive recording layer 3 with a #4 wire bar, dried (at 80° C., for 5 minutes), put under ultraviolet irradiation (160W/cm, 30 m/min, 1 pass), so as to form a protective layer of a dried layer thickness of 2 μm. At this point, on measuring the surface roughness of the protective layer, the roughness becomes Ra=0.28 μm.

Protective Layer Forming Resin

Materials for composition shown below are put in a container, where zirconia beads with a 2 mm diameter are added. Then this is dispersed for 10 minutes by a paint shaker in order to manufacture the coating (protective layer forming resin).

| | |
|---|---|
| Ultraviolet hardening coating (produced by Dainippon Ink and Chemicals Incorporated, name of product Unidick 17-806, 80% solid portion) | 100 weight parts |
| Silica (produced by Fuji Silysia Chemical Ltd., name of product Sylysia 436) | 5 weight parts |
| Silicon oil (produced by Shin-Etsu Chemical Co., Ltd., name of product KF 96) | 3 weight parts |
| Solvent (MEK: toluene = 1:1) | 150 weight parts |

Punching

The welded product where the protective layer 1 is formed on the reversible heat-sensitive recording layer 3 is punched by a metal mold to have an external form prescribed by JISX6301 in order to manufacture a card.

EXAMPLE 4

Figure 4D:
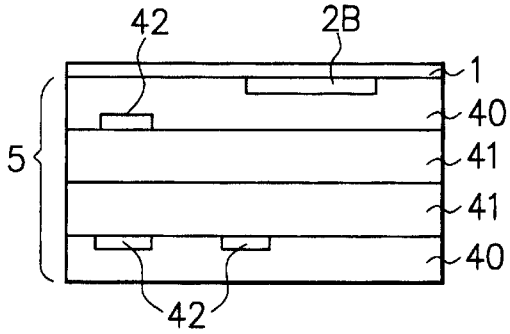
FIG. 4D is a sectional schematic view showing an example of a reversible heat-sensitive recording medium manufactured as a card using the reversible heat-sensitive recording transfer sheet made by the manufacturing method of the present invention, as the reversible heat-sensitive recording sheet is applied to a part of the surface of a substrate sheet.

In this Example, instead of the reversible heat-sensitive recording transfer sheet used in Example 3, a reversible heat-sensitive recording transfer sheet as shown in FIG. 3C having a concealing layer as described below provided between a barrier layer and the adhesive layer 4 is used. This reversible heat-sensitive recording transfer sheet is slit into a tape shape according to a slit formation described below, and this tape shaped reversible heat-sensitive recording transfer sheet and the substrate sheet are attached to each other through welding to form a welded product. The rest of the process is the same as that of Example 3, resulting in forming a card of reversible heat-sensitive recording medium 10 shown in FIG. 4D.

Concealing Layer

Materials for composition shown below are agitated by an agitator for 30 minutes to manufacture a coating. This coating is applied to the barrier layer with a #10 wire bar, dried (at 80° C., for 5 minutes), so as to form a concealing layer of a dried layer thickness of 3 μm.

| | |
|---|---|
| Aluminum paste (produced by Asahi Chemical Industry Co., Ltd., name of product MH8803) | 9 weight parts |
| Vinyl chloride - vinyl acetate - maleic anhydride copolymer (produced by Unioncarbide Co., Ltd., name of product VMCH) | 11 weight parts |
| Solvent (MEK: toluene = 1:1) | 40 weight parts |

Forming Slit

In order to separate in a desirable width, a slit is formed on the reversible heat-sensitive recording transfer sheet 2B.

COMPARISON EXAMPLE 2

A card of a reversible heat-sensitive recording medium is manufactured in the same manner as in Example 3, except that a reversible heat-sensitive recording sheet with a protective layer of a 92 $\mu$m thickness previously being provided is used instead of the reversible heat-sensitive recording transfer sheet used in Example 3, and except that the forming process of a protective layer after welding is omitted. As to the rest of the process, a card of reversible heat-sensitive recording medium is manufactured in the same manner as in Example 3. At this point, on measuring the surface roughness of the protective layer, the roughness becomes Ra=0.03 $\mu$m.

Printing/Erasing Test

Using each card obtained in each of Examples 1 to 4 and Comparison Examples 1 and 2, printing/erasing was repeated 100 times for each card under situation where dirt and dust tend to attach.

The cards in Examples 1 to 4 were proved as capable of executing fine printing/erasing, and it was acknowledged that there was no scratches, etc. caused on the surface of the card.

On other hand, in Comparison Examples 1 and 2, although it was acknowledged that printing/erasing was executed, there were many scratches caused on the surface of the card.

According to the manufacturing method of the present invention, the reversible heat-sensitive recording medium is manufactured by welding a reversible heat-sensitive recording sheet or a reversible heat-sensitive recording transfer sheet without applying heat and/or pressure in forming a particular protective layer after that.

Therefore, cards which use such reversible heat-sensitive recording medium provided by the present invention will be invulnerable toward scratches, etc. even when printing/erasing is repeated under situation of dirt and dust attached to the card. Consequently, it is possible to increase durability of the card (reversible heat-sensitive recording medium) against repeated printing/erasing.

Furthermore, the reversible heat-sensitive recording medium of the present invention has a function of cleaning the surface of the thermal head.

While the preferred embodiments of the invention have been described using specific terms, such description is for illustrative purposes only, and it is to be understood that changes and variations may be made without departing from the spirit or the scope of the following claims.

What is claimed is:

1. A method of manufacturing a reversible heat-sensitive recording medium comprising a reversible heat-sensitive recording layer and a substrate sheet, the method comprising:

welding one of a reversible heat-sensitive recording sheet and a reversible heat-sensitive recording transfer sheet to the substrate sheet, the one of the reversible heat sensitive recording sheet and the reversible heat-sensitive recording transfer sheet comprising the reversible heat-sensitive recording layer; and forming a protective layer on the reversible heat-sensitive recording layer subsequent to the welding.

2. The method of manufacturing a reversible heat-sensitive recording medium as claimed in claim 1, the protective layer comprising porous filler.

3. The method of manufacturing a reversible heat-sensitive recording medium as claimed in claim 2, the porous filler comprising a plurality of particles having an average particle diameter within a range of 0.7–2.5 times a thickness of the protective layer.

4. The method of manufacturing a reversible heat-sensitive recording medium as claimed in claim 1, wherein the one of the reversible heat-sensitive recording sheet and the reversible heat-sensitive recording transfer sheet does not have a protective layer separate from the protective layer of the reversible heat-sensitive recording layer.

5. The method of manufacturing a reversible heat-sensitive recording medium as claimed in claim 4, the reversible heat-sensitive recording layer comprising at least a leuco dye, a color developing/reducing agent, and a binder resin.

6. A method of manufacturing a reversible heat-sensitive recording medium comprising a reversible heat-sensitive recording layer and a substrate sheet, the method comprising:

welding one of a reversible heat-sensitive recording sheet and a reversible heat-sensitive recording transfer sheet to the substrate sheet, the one of the reversible heat-sensitive recording sheet and the reversible heat-sensitive recording transfer sheet comprising the reversible heat-sensitive recording layer; and coating a protective layer on the reversible heat-sensitive recording layer subsequent to the welding, the protective layer comprising a surface roughness within a range of Ra values of 0.10–0.60 $\mu$m.

7. A reversible heat-sensitive recording medium comprising:

a substrate sheet;

one of a reversible heat-sensitive recording sheet and a reversible heat-sensitive recording transfer sheet welded to the substrate sheet, the one of the reversible heat-sensitive recording sheet and the reversible heat-sensitive recording transfer sheet comprising a reversible heat-sensitive recording layer; and a protective layer formed on the reversible heat-sensitive recording layer of the one of the reversible heat-sensitive recording sheet and the reversible heat-sensitive recording transfer sheet, the protective layer comprising a surface roughness within a range of Ra values of 0.10–0.60 $\mu$m.

* * * * *